United States Patent [19]

Nakatsugawa

[11] Patent Number: 4,778,571

[45] Date of Patent: Oct. 18, 1988

[54] METHOD OF MAKING ELECTROLYTIC METAL FOIL AND APPARATUS USED THEREFOR

[75] Inventor: Hiroshi Nakatsugawa, Yokohama, Japan

[73] Assignee: Furukawa Circuit Foil Co., Ltd., Tokyo, Japan

[21] Appl. No.: 128,816

[22] Filed: Dec. 4, 1987

[30] Foreign Application Priority Data

Dec. 12, 1986 [JP] Japan ..... 61-294749

[51] Int. Cl.[4] ..... C25D 1/04

[52] U.S. Cl. ..... 204/13; 204/216

[58] Field of Search ..... 204/13, 216

[56] References Cited

U.S. PATENT DOCUMENTS

| | | | |
|---|---|---|---|
| 1,952,762 | 3/1934 | Levy et al. | 204/28 |
| 1,969,054 | 8/1934 | Wilkins | 204/11 |
| 1,978,037 | 10/1934 | Yates | 204/13 |
| 2,044,415 | 6/1936 | Yates | 204/13 |
| 2,865,830 | 12/1958 | Zoldas | 204/208 |
| 3,151,048 | 9/1964 | Conley et al. | 204/13 |

FOREIGN PATENT DOCUMENTS

| | | | |
|---|---|---|---|
| 2225541 | 11/1974 | France . | |
| 1117642 | 6/1968 | United Kingdom | 204/13 |
| 1426071 | 2/1976 | United Kingdom | 204/13 |
| 1555458 | 11/1979 | United Kingdom . | |

*Primary Examiner*—T. M. Tufariello

*Attorney, Agent, or Firm*—Frishauf, Holtz, Goodman & Woodward

[57] ABSTRACT

Disclosed is a method of making electrolytic metal foil, comprising carrying out electrolysis by filling with an electrolytic solution a space defined between a cathode drum capable of rotating on a horizontal axis and an anode provided in face of the surface of the drum, wherein the electrolytic solution is allowed to flow down from the upper part toward the lower part of the space at the flow velocity such that a gas generated in the solution during the electrolysis may virtually flow out downward in its whole quantity. Disclosed also is an apparatus for making electrolytic metal foil, comprising a cathode drum capable of rotating on a horizontal axis, an anode provided in face of the surface of the drum and provided a solution discharging outlet which allow a gas generated during the electrolysis to flow down the space between the both electrodes at the flow velocity such that the gas generated may downward flow out virtually in its whole quantity together with an electrolytic solution for metal electrodeposition.

According to this invention, the resulting electrolytic foil can be of dense texture and of excellent physical properties and surface states.

6 Claims, 2 Drawing Sheets

METHOD OF MAKING ELECTROLYTIC METAL FOIL AND APPARATUS USED THEREFOR

BACKGROUND OF THE INVENTION

This invention relates to a method of making electrolytic metal foil and an apparatus used therefor. More particularly, it is concerned with a method that can make metal foil of good quality, particularly an electrolytic copper foil for a printed circuit, in a high current density and high electric power efficiency, which foil is of dense quality and excellent physical properties and has a roughened surface with minute and uniform irregularities, and further can substantially perfectly prevent equipments or atmospheres from being contaminated owing to the splashing of an electrolytic solution or the generation of mist during the electrolytic making, and resulting foil from being lowered in quality, and also concerned with an apparatus used for making the same.

Of the electrolytic metal foil, nowadays produced in greatest quantities is electrolytic copper foil for printed circuits. Almost all of this electrolytic copper foil are produced in a continuous process according to the method as described below.

Namely, it has been practiced to horizontaly support a drum whose surface is comprised of stainless steel, titanium or a chromium coating and dipping it in part in an electrolytic solution comprising, for example, copper sulfate and sulfate; cause a direct current to flow between an opposite electrode provided in face of the surface of the drum in the solution, having a surface of, for example, copper, lead, platinum or a platinum group oxide, and the drum surface serving as a cathode; rotate the drum while controlling the intensity of the electric current and the rotational speed so that the electrodeposited copper may come out from the solution in the air exactly when it was built up to a desired thickness; strip off the electrodeposited copper layer from the drum; and then winding it up.

What is required for continuing the electrolytic treatment and producing electrolytic copper foil of good quality is that the electrolytic solution held between the both electrodes is circulated, agitated and refreshed, and a variety of methods and apparatus have been hitherto proposed for such purposes.

For example, the apparatus disclosed in U.S. Pat. No. 1,978,037 is of the type in which anodes provided in face of a cathode drum in an electrolytic tank are divided right and left into two portions to have a gap therebetween, wherein, once the electrolysis is effected, the electrolytic solution held between the both electrodes rises along with a rise of generated gas until it overflows from an upper end of the anodes, and the electrolytic solution in the electrolytic tank is sucked up from the gap between the anodes at the central lower part to the space defined between the both electrodes, so that the electrolytic solution between the both electrodes can be refreshed in this manner.

U.S. Pat. No. 1,952,762 also discloses a type in which three gaps are provided between the above anodes.

U.S. Pat. No. 2,044,415 further discloses an apparatus in which a pipe for ejecting air for agitating the electrolytic solution held between the both electrodes is provided beneath the gap between the above anodes.

U.S. Pat. No. 2,865,830 discloses an apparatus in which a electrolytic solution feeding pipe formed with a large number of holes capable of flowing out the solution is provided at the gap between the above mentioned anodes, and the electrolytic solution is ejected from said solution feeding pipe to the space defined between the both electrodes.

U.S. Pat. No. 1,969,054 discloses an apparatus in which a plurality of holes are formed through an arcuately shaped anode provided substantially horizontally around a cathode drum over about 40°, an electrolytic solution ejected from these holes are so made as to turn to a jet stream colliding against the cathode surface through a layer of the electrolytic solution that flows in the space between the both electrodes and along them, and dams for overflow and underflow are provided on the outlet side of the electrolytic solution to keep constant the liquid level of the electrolytic solution at the outlet side, so that the space between the both electrodes can be filled with the solution to keep a steady flow.

U.S. Pat. No. 3,151,048 further discloses an apparatus in which a plurality of pure copper bars is set up as anodes in face of the operative surface of a cathode drum, and a plurality of perforated agitator pipes is horizontally provided in the lateral direction in the space between the both electrodes, whereby the electrolytic solution in an electrolytic tank is injected into said agitator pipes by means of a pump and vertically ejected to the cathode drum surface from the holes formed on said agitator pipes.

British Patent No. 1,117,642 also discloses an apparatus in which an electrolytic solution is fed to perforated pipes provided beneath the gap between anodes, and caused to be injected from the holes into the space between both electrodes and then overflows from an open end at the upper part of said space.

As stated in the above, any of the conventionally known methods for making electrolytic metal foil and apparatus used therefor are of the type in which the electrolytic solution fed to the space between the both electrodes rises from the lower part to the upper part in said space to overflow from an upper open end.

However, the conventional methods of this type may inevitably be accompanied with a disadvantageous problem as stated below. Namely, the problem is that there is a limitation in the operation in which the flow velocity of the electrolytic solution to be allowed to flow into said space is made larger in order to refresh as highly as possible the electrolytic solution present at the space between the both electrodes. In order to make larger the flow velocity of the electrolytic solution at said space, the electrolytic solution may be injected in a large quantity and under a large pressure. However, if the pressure is made overly large, the electrolytic solution may be blown up from the upper open end of said space, causing the situation such that the solution blown up falls upon the surface of the cathode drum in scattered particles, or a mist is formed owing to gas generated by the electrolysis and may fly to impair the work environment.

For this reason, the flow velocity of the electrolytic solution must be limited to the extent that the above undesirable situation may not be caused. In the case when the flow velocity of the electrolytic solution to be fed to the space between the both electrodes is limited, the electrolytic solution present in said space can not be said to be in a refreshed state, also is in the state in which it contains a large quantity of generated gas. As a result, since the substantial density of copper ions fed to an electrolytic part is not sufficient, it is impossible to use a large current density. Moreover, the copper foil to be formed may not have sufficiently favorable physical properties and surface states, further resulting in the disadvantage that the electric power consumption may be increased because of the large electric resistance of the solution caused by the presence of generated gas.

SUMMARY OF THE INVENTION

Accordingly, an object of this invention is to solve the above problems involved in the prior arts to provide a novel method, and an apparatus used therein, that can make greatly large the flow rate or flow velocity of the electrolytic solution fed to the space between the both electrodes to sufficiently refresh the electrolytic solution present in said space, thus bringing about the advantages such that there can be produced electrolytic metal foil having excellent physical properties and surface states, and moreover it is made possible to use the high electric density to increase the productivity.

The method of making electrolytic metal foil of this invention is characterized by a method of making electrolytic metal foil, comprising carrying out electrolysis by filling with an electrolytic solution a space defined between a cathode drum capable of rotating on a horizontal axis and an anode provided in face of the surface of the drum, wherein said electrolytic solution is allowed to flow down from the upper part toward the lower part of said space at the flow velocity such that a gas generated in the solution during said electrolysis may virtually flow out downward in its whole quantity, and also an apparatus used therefor is characterized by comprising the above mentioned cathode drum, the anode provided in face of the surface of the drum and provided a solution discharging outlet which allow a gas generated during the electrolysis to flow down the space between the both electrodes at the flow velocity such that the gas generated may downward flow out virtually in its whole quantity together with an electrolytic solution for metal electrodeposition.

DESCRIPTION OF THE PREFERRED EMBODIMENTS

This invention is most characterized in that, in a method or apparatus for making electrolytic metal foil by use of a rotary cathode drum, the electrolytic solution to be fed to the space between the both electrodes is fed from an upper end of the space between the both electrodes to flow downward while filling said space, and is allowed to flow out from a solution discharging outlet positioned at the lower part of the anode, and the flow velocity of the electrolytic solution at this time is the velocity such that at least the gas generated in the solution during said electrolysis may downward flow out virtually in its whole quantity by virtue of the electrolytic solution without rising from the lower part to the upper part. It is not particularly required to make different the composition, temperature and so forth of the electrolytic solution from those in the conventional instances.

This invention will be described below in line with the accompanying drawings.

Figure 1:
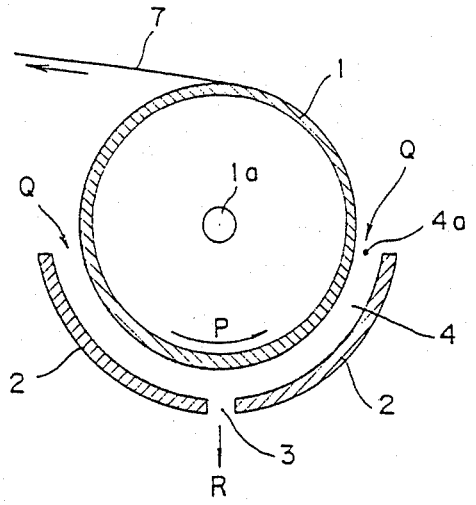
FIG. 1 is a typical cross-section of an example of the apparatus of this invention.

FIG. 1 is a typical cross-section of an example of the apparatus of this invention. In the drawing, the numeral 1 denotes a cathode drum, which is so provided that its drum surface is dipped in part or as a whole in the electrolytic solution and the drum is capable of rotating around a horizontal central axis 1*a*. The numeral 2 denotes anodes, which are provided in face of the surface of the drum dipped in the electrolytic solution, and is formed with a solution discharging outlet 3 at the lower part of the anodes 2. The solution discharging outlet 3 may be formed at the center of the bottommost part of the anodes 2, or in the vicinity thereof, in the form of a slot extending in the direction of the central axis 1*a* of the cathode drum 1 (the direction vertical to the face of the paper of FIG. 1), or may be formed in the form of a plurality of holes provided in series. The anodes 2 may be comprised of the two merely consisting of right and left ones, or, alternatively, may be of the type in which one or both of the anodes is/are comprised of a plurality of anodes, or may further be of the type in which electric currents having different intensity can be flowed respectively.

The numeral 4 denotes a space defined between the rotary cathode drum 1 and the anodes 2. There is no particular limitation in the width of this space 4, and, in practice, it may be appropriately selected from the range between several millimeters and several 10 millimeters, more preferably 3 to 25 millimeters, further preferably 5 to 12 millimeters.

The electrolytic solution is continuously fed from an upper end 4*a* of said space 4 so that this space 4 may be filled with the electrolytic solution, and the feeding rate thereof is set so as to keep constant the upper liquid level in the space 4 by taking the balance with the quantity of the solution to be discharged from the solution discharging outlet 3.

In this instance, the larger the discharging rate of the electrolytic solution is made, the larger the rate of the electrolytic solution flowing down the space 4 becomes, to improve the refreshing of the electrolytic solution present in said space 4.

Since the fresh electrolytic solution flows down in a high speed through the space 4 between the both electrodes, it is made possible to produce electrolytic metal foil endowed with excellent physical properties and surface states. Moreover, it becomes possible to use a high current density, resulting in improvement in the productivity. Also, since the gas generated at the time of the electrolysis flows out to be removed in a high speed from the space 4 toward the lower part, the effect of using a high current density can be promoted, eliminating the disadvantage that an atmosphere above the liquid surface of the electrolytic solution is contaminated with the mist containing the electrolytic solution.

Figure 2:
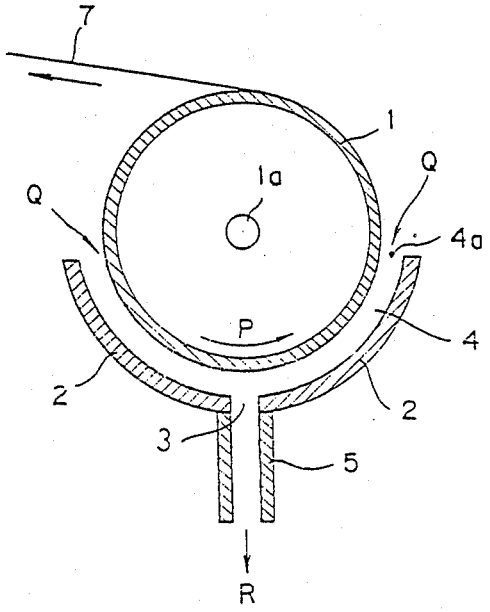
FIG. 2 and FIG. 3 each are an exemplary illustration of another embodiment.
Figure 3:
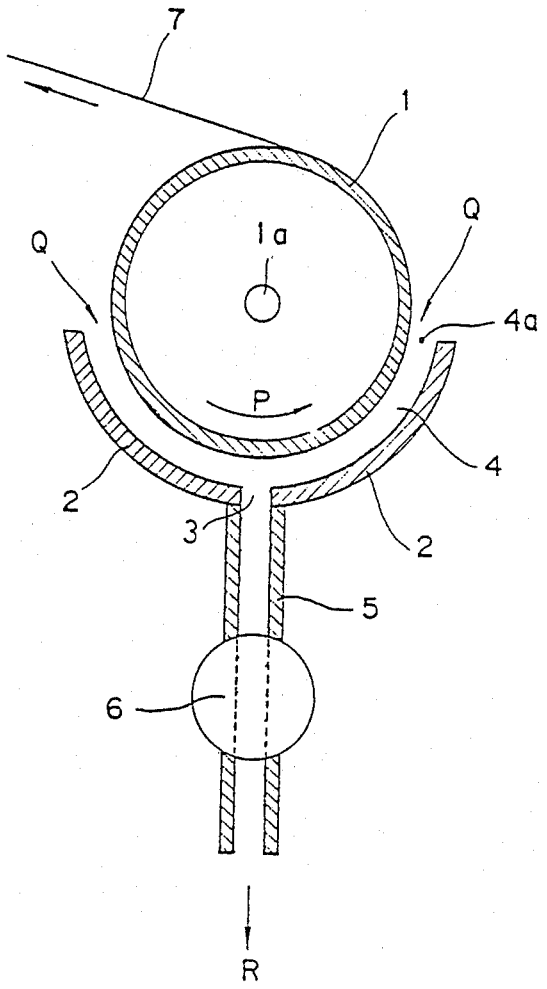

Accordingly, even in the type in which as shown in FIG. 1 the solution discharging outlet 3 is kept open at the lower part position of the anodes so that the electrolytic solution in the space 4 naturally may flow down by its gravity, the electrolytic solution in the space 4 can be made to flow down with considerable rapidity by selecting the width and shape of the solution discharging outlet 3 and the width of the space 4, and thus the invention can be effective as compared with the conventional cases. However, as shown in FIG. 2, an electrolytic solution flow-out tube 5 may be further provided to the solution discharging outlet 3 to allow the electrolytic solution to fall with fullness through said pipe 5, so that the gravity at that part can be added to more increase the rate of the electrolytic solution flowing down through the space 4, desirably. If a suction pump 6 is additionally provided on the flow-out pipe 5 as shown in FIG. 3, the flowing-down rate of the electrolytic solution can be more enhanced, effectively, and it can be also made easy to control the flowing-down rate to a desired given degree.

Thus, even in the instance in which the electrolytic solution is introduced from the upper part and is allowed to flow out from the lower part, the effect as mentioned above can not be obtained, resulting also in insufficient properties of the foil produced and also in no elimination of the contamination by mist of the atmosphere above the surface of the electrolytic solution, if the solution flowing down in the space 4 is in the same flow quantity as that in the conventional instance in which the solution is allowed to overflow from the lower part to the upper part.

Also, in instances in which the flow-down rate of the electrolytic solution is not the rate that may not cause the gas generated at the time of the electrolysis to flow out virtually in its whole quantity from the discharging outlet together with the electrolytic solution, the gas generated flows upward and exhale from the liquid surface of the electrolytic solution to cause the contamination by mist, and moreover it follows that the electrolytic solution itself rises because of a lowering of the apparent specific gravity owing to the bubbles. For these reasons, an effective flow-down rate of the electrolytic solution may preferably be 50 mm/sec or more, more preferably 60 mm/sec or more, and particularly preferably 120 mm/sec or more, in terms of the average flow velocity value obtained by dividing an average flow rate of the electrolytic solution flowing down through the space 4 between the both electrodes, by the sectional area of the space 4.

For this purpose, in the instance in which the solution is allowed to flow down by gravity, it is required to make the passage or outlet of the electrolytic solution to have a suitable shape or dimension. It is also effective to provide the flow-out pipe, and further the forced suction and discharge by means of a pump can be made effectual.

To make the electrolytic metal foil, in these apparatus the electrolysis may be carried out while rotating the rotary cathode drum 1 at a given speed in the direction, for example, of the arrow P, feeding the electrolytic solution from the upper end 4*a* of the space 4 in the manner, for example, as shown by the arrow Q, and discharging it from the solution discharging outlet 3 as shown by the arrow R, followed by stripping off the metallic layer formed on the drum surface of the rotary cathode drum 1 to continuously produce it as metal foil 7. Here, the rotary cathode drum 1 may be so supported that about $\frac{1}{3}$ to substantially the whole of the drum surface is dipped in the electrolytic solution.

The gas generated in the course of this electrolysis is included in the electrolytic solution rapidly falling, and effectively moved downward in a pulled-down fashion and discharged, so that it may not rise upward. As a result, it may not occur that the electrolytic solution jumps up in scattered particles from the liquid surface thereof or the mist flies in the space above the liquid surface, and it may also not occur that gas floats in the solution present in the space 4 to impair the properties of the metal foil to be formed and enlarge the electric power consumption with increase in the electric resistance of the solution.

Meanwhile, in order to promote the feeding of the electrolytic solution and the flowing-down of the generated gas, a plurality of electrolytic solution feeding holes may be bored on the operative surface of the anodes 2 to eject therefrom the electrolytic solution, or an auxiliary electrolytic solution feeding pipe may be additionally provided inside the space 4

EXAMPLES

Example 1

The cathode drum 1 whose drum surface was comprised of titanium, having a diameter of 500 mm and having a length of 450 mm at its drum portion, and the anodes 2 whose arcuate inner surface was comprised of lead were so combined as to be distant 10 mm from each other to construct the apparatus as shown in FIG. 2. The electrolytic solution flow-out tube 5 was 30 mm in inner diameter and 600 mm in length.

First, the bottom end of the flow-out tube 5 was closed, and the space 4 of the both electrodes was filled with an electrolytic solution at a temperature of 60° C. having the composition of 110 g/lit of $Cu^{2+}$, 70 g/lit of $H_2SO_4$ and 3 mg/lit of glue. Subsequently, the bottom end of the flow-out tube 5 was opened to allow the electrolytic solution to flow down, and at the same time the above mentioned electrolytic solution was continuously fed from the upper end 4*a* of the space 4 so that the liquid surface at the space upper end 4*a* can be kept constant. The feeding quantity of the electrolytic solution at this time was found to be about 140 lit/min. Here, the average flow velocity of the electrolytic solution flowing down through the space 4 was found to be 260 mm/sec. A direct current of 90 A/dm$^2$ was flowed between the both electrode, and the cathode drum was so rotated that the foil may have a thickness of 35 $\mu$m after the electrolysis, to make copper foil continuously. The gas generated by the electrolysis did not rise toward the upper liquid surface of the electrolytic solution and discharged from the discharging outlet 3 virtually in its whole quantity while being pulled down by the electrolytic solution flowing down.

Properties of the resulting copper foil are shown in the table following.

Example 2

Using the apparatus exemplified in FIG. 3, the continuous production of copper foil was carried out in the same manner as in Example 1 except that an electrolytic solution was forced to discharge at a rate of 800 lit/min and the electrolytic solution was supplied to the space upper end 4*a* in the quantity necessary for keeping constant the liquid level at that part. At this time, the average flow velocity of the electrolytic solution flowing down through the space 4 was found to be about 1,480 mm/sec. Properties of the resulting copper foil are shown in the table.

Comparative Example

Using the apparatus exemplified in FIG. 1, the continuous production of copper foil was carried out in the same manner as in Example 1 except that an electrolytic solution was injected from the discharging outlet 3 at a rate of 50 lit/min to cause the solution to overflow from the upper end of the anodes 2, and the electrolysis was carried out at a current density of 65 A/dm$^2$. Properties of the resulting copper foil are shown in the table.

TABLE

| | Surface roughness (RZ: μm) | Tensile strength (Kg/mm²) | Elongation (%) | Flexing* (times) |
|---|---|---|---|---|
| Example 1 | 1.3 | 34 | 7 | 430 |
| Example 2 | 1.2 | 34 | 8 | 440 |
| Comparative Example | 8.7 | 32 | 3 | 25 |

*In accordance with JIS P-8115, using a MIT test machine, 0.8 R.

As will be clear from the foregoing description, according to the method of this invention, a rapid flow of the electrolytic solution can be formed toward the upper part to the lower part in the space of the both electrodes, so that the resulting electrolytic metal foil can be of dense texture and of excellent physical properties and surface states, and also there can be eliminated the conventionally involved situation that the electrolytic solution is splashed or the mist is generated. Since the metallic ions to be electrodeposited can be fed in a high speed and abundantly, it becomes possible to operate with a high current density. Also, since the generated gas can be rapidly removed by virtue of the flow of the electrolytic solution flowing down in a high speed and the electrical resistance of the electrolytic solution between the both electrodes can not be increased, the electric power to be consumed for the electrolysis can be made small and the productivity can be improved, bringing about very great industrial values. Moreover, in applying the method of this invention, a satisfactory result can be obtained by feeding the electrolytic solution in an up-and-down reverse manner to the conventional method, merely making large the capacity of a device for feeding the electrolytic solution, and by exerting the originality such that, for example, the flow-out tube is provided in order to cause a large volume of electrolytic solution to flow down in a high speed through the space 4 and the solution discharging pump is further additionally provided thereto. Accordingly, it is not required to greatly modify the conventional apparatus, and also there may not be any new difficulties or problems to be solved for putting the present method into practical use.

I claim:

1. A method of making electrolytic metal foil, comprising:

carrying out electrolysis by filling, with an electrolytic solution, a space defined between a cathode drum which is rotatable on a substantially horizontal axis and an anode facing and spaced from the surface of said drum, and flowing said electrolytic solution downwardly from an upper part toward a lower part of said space at a flow velocity sufficiently high that substantially all of a gas generated in said electrolytic solution during said electrolysis flows out downwardly through said space to an outlet provided in the vicinity of the lower part of said space.

2. The method of claim 1, comprising flowing said electrolytic solution downwardly at an average flow velocity of at least 50 mm/sec.

3. An apparatus for making electrolytic metal foil, comprising:

a cathode drum which is rotatable on a substantially horizontal axis;

an anode spaced from and facing the surface of said drum so as to define a space therebetween; and means including a solution discharging outlet at lower portion of said space, for flowing an electrolytic solution downwardly in said space from an upper portion to a lower portion of said space, at a flow velocity sufficiently high that substantially all of a gas generated during the electrolysis flows downwardly in said space and such that substantially all of said gas flows downwardly and out of said space through said outlet together with said downwardly flowing electrolytic solution.

4. The apparatus of claim 3, wherein said flow velocity of said electrolytic solution is 50 mm/sec as an average flow velocity.

5. The apparatus of claim 3, wherein said solution discharging outlet comprises an electrolytic solution flow-out tube means extended downwardly for discharging said electrolytic solution from said space.

6. The apparatus of claim 5, wherein said electrolytic solution flow-out tube means comprises a solution discharging pump.

* * * * *